US005558805A

United States Patent [19]

Colclough et al.

[11] Patent Number: 5,558,805

[45] Date of Patent: Sep. 24, 1996

[54] LUBRICATING COMPOSITIONS

[75] Inventors: Terence Colclough, Abingdon, United Kingdom; Morton Beltzer; Jacob J. Habeeb, both of Westfield, N.J.

[73] Assignee: Exxon Chemical Patents Inc, Linden, N.J.

[21] Appl. No.: 410,251

[22] Filed: Mar. 24, 1995

[30] Foreign Application Priority Data

Mar. 24, 1994 [GB] United Kingdom ..... 9405903

[51] Int. Cl.[6] ..... C10M 141/12

[52] U.S. Cl. ..... 508/243; 508/245; 508/248; 508/259; 508/262; 508/269; 508/271; 508/283; 508/558

[58] Field of Search ..... 252/47, 47.5, 35

[56] References Cited

U.S. PATENT DOCUMENTS

| | | | |
|---|---|---|---|
| 2,343,756 | 3/1944 | Downing et al. | 252/37 |
| 2,351,657 | 6/1944 | Bayes | 252/47.5 |
| 2,364,122 | 12/1944 | Bayes | 252/47.5 |
| 2,384,002 | 9/1945 | Bayes | 252/47.5 |
| 2,598,333 | 5/1952 | Zerbe | 252/47 |
| 2,648,673 | 8/1953 | Lesslie | 252/47 |
| 3,394,185 | 7/1968 | Clemens | 260/583 |
| 3,644,408 | 2/1972 | Hill | 260/246 B |
| 4,096,078 | 6/1978 | Yaffe | 252/46.7 |
| 4,104,179 | 8/1978 | Colclough | 252/47.5 |
| 4,482,463 | 11/1984 | Dubas et al. | 252/47.5 |
| 4,664,822 | 5/1987 | Hunt et al. | 252/3.27 E |
| 4,867,890 | 9/1989 | Colclough et al. | 252/47 |
| 5,171,461 | 12/1992 | Di Biase et al. | 252/46.4 |

FOREIGN PATENT DOCUMENTS

| | | | |
|---|---|---|---|
| 0024146 | 2/1981 | European Pat. Off. | C10M 1/08 |
| 0280579 | 8/1988 | European Pat. Off. | C10M 141/08 |
| 0280580 | 8/1988 | European Pat. Off. | C10M 141/08 |

OTHER PUBLICATIONS

"Interaction of Sulfur–Containing Additives with Metals" G. N. Novitskaya, E. V. Lebedev, T. I. Sarnavskaya All–Union Scientific Research and Design Institute of the Petroleum Refining and Petrochemical Industry, Plenum Publishing Corporation, 1980, pp. 258–260.

"Vulcanization Characteristics of N,N'–Dithioamines in Furnace Black Stocks", M. C. Throdahl and M. W. Harman, Ind. Eng. Chem., 43, 1951, 421–429.

*Primary Examiner*—Jerry D. Johnson
*Attorney, Agent, or Firm*—Estelle C. Bakun

[57] ABSTRACT

Crankcase lubricant compositions for use in automobile or truck engines comprise a major amount of a lubricating oil, added copper present in oil-soluble form and an oil-soluble diamine sulphide. The specified additives provide a highly effective antioxidant system, which may be used, for example, in lubricating oils which are substantially free of phosphorus.

17 Claims, No Drawings

LUBRICATING COMPOSITIONS

The present invention relates to lubricating compositions, especially crankcase lubricants for automobiles and trucks.

BACKGROUND OF THE INVENTION

There is an increasing demand for longer intervals between changes of crankcase oils, and for a reduction in the volume of used oil to be disposed of. For these and other reasons, there is a need to improve the efficiency and useful life of oil-based lubricants, particularly those used as crankcase lubricants in internal combustion engines in automobiles and trucks.

One of the factors which substantially shortens the useful life of lubricating compositions is oxidation of the oil component. Oxidation results in the formation of acids, which tend to corrode engine parts, and in an undesirable increase in viscosity, which renders the composition less useful as a lubricant.

While high quality oils are themselves relatively resistant to oxidation, contaminants, for example iron, which are inevitably present in internal combustion engines, and common lubricant additives, for example magnesium- and/or calcium-containing detergents and alkenyl succinic acid/polyamine or polyester dispersants, have the effect of greatly accelerating the oxidation process, to the extent that oxidation is one of the major contributors to reduced lubricant life. Further, lower quality basestocks have a greater tendency to oxidize than do basestocks of higher quality.

Examples of oxidation inhibitors which have been proposed for used in crankcase lubricants are zinc dihydrocarbyl dithiophosphates which, although primarily used as antiwear agents, also act as antioxidants; aromatic amines, for example, alkylated diphenylamines and phenyl-oc-naphthylamines; hindered phenols; alkaline earth metal salts of sulphurized alkyl phenols in which the alkyl groups preferably contain 5 to 12 carbon atoms, for example, calcium nonylphenyl sulphide and barium octylphenyl sulphide; phosphosulphurized or sulphurized hydrocarbons; and oil-soluble copper compounds.

Some of the above-mentioned oxidation inhibitors have been found to be very effective in use. European Patent Specification No. 24 146 B claims lubricating compositions comprising a major amount of lubricating oil, from 1 to 10 wt. % of certain ashless dispersant compounds or from 0.3 to 10 wt. % of certain nitrogen- or ester-containing polymeric viscosity index improver dispersants, or mixtures of dispersant(s) and viscosity index improver dispersant(s), 0.01 to 5 wt. % of zinc dihydrocarbyl dithiophosphate (ZDDP) and 5 to 500 parts per million by weight of added copper in the form of an oil-soluble copper compound. For particularly severe conditions, where it may be desirable to use a supplementary antioxidant, the amount of the supplementary antioxidant required is small (far less than the amount required in the absence of the copper compound). Supplementary antioxidants mentioned in Specification No. 24 146 B include diphenylamine, alkylated diphenylamines, and phenyl-1-naphthylamine and its alkylated derivatives.

European Specifications Nos. 280 579A and 280 580A disclose the use of an oil-soluble copper compound, an oil-soluble sulphur-containing compound, and a bearing corrosion inhibitor in crankcase lubricating oils which are suitable for meeting modern requirements and which contain low or zero proportions of phosphorus. The oil-soluble sulphur-containing compounds disclosed include dithiocarbamates, polysulphides, and thiadiazoles. Borate esters and thiadiazole polysulphides are mentioned as bearing corrosion inhibitors.

U.S. Pat. Nos. 2,343,756 and 235,661 disclose the addition of oil-soluble copper compounds and oil-soluble sulphur-containing compounds to lubricating oils. The oil-soluble sulphur-containing compounds disclosed include polysulphides and thiocarbamates.

Despite the effectiveness of the copper-containing compositions disclosed in Specifications Nos. 24146, 280579 and 280580 discussed above, alternative highly effective antioxidants for lubricating compositions, particularly lubricating compositions suitable for use as crankcase lubricants containing, if desired, low or zero proportions of phosphorus, would represent an important contribution to the art. Phosphorus is known to have a deleterious effect on catalysts commonly used in catalytic converters used for emission control in automobiles.

It has now been found that copper and diamine sulphides, especially diamine polysulphides, provide surprisingly good oxidation control as the sole antioxidant system, or in combination with other antioxidants.

SUMMARY OF THE INVENTION

The present invention provides a lubricating composition suitable for use as a crankcase lubricant, comprising a major amount of a lubricating oil, at least 5 parts per million by mass (ppm) of added copper present in oil-soluble form, and from 0.05 to 5 mass % of one or more oil-soluble diamine sulphides, especially diamine polysulphides, and the use of such a composition as a crankcase lubricant.

The invention further provides the use of at least 5 ppm of copper present in oil-soluble form, and a total of from 0.05 to 5 mass % of one or more oil-soluble diamine sulphides, especially diamine polysulphides, to inhibit oxidation of a crankcase lubricant composition.

The applicants have surprisingly found that the use of the antioxidant system in accordance with the invention makes it possible to obtain high levels of antioxidant activity using no phosphorus or only very low levels of phosphorus in the system (although the use of higher levels of phosphorus is not excluded in some circumstances). They have also found that systems containing three or more components (where the copper/diamine sulphide system is used with an additional antioxidant) may give excellent oxidation control.

A number of specifications, discussed below, disclose compounds containing —N—$(S)_n$—N— groups as additives for oils. None of the specifications, however, discloses the use of the compounds in question in unused lubricating oils which also contain oil-soluble copper.

U.S. Pat. No. 3,394,185 discloses the use of N,N'-bis(t-alkylamino) disulphides as fungicides, corrosion inhibitors and chemical intermediates.

An article entitled "Interaction of sulphur-containing additives with metals" (G. N. Novitskaya, E. V. Lebedev and T. I. Sarnavskaya: All-Union Scientific Research and Design Institute of the Petroleum Refining and Petrochemical Industry, Plenum Publishing Corporation, 1980, pp 258 to 260) describes the results of heating with various metals three specific compounds, including dimorpholinyl disulphide and dimorpholinyl tetrasulphide, said to be antioxidants for lubricating oils. The article, which is concerned with corrosivity of sulphur-containing additives, refers to heating the compounds with powdered copper to give copper sulphides.

U.S. Pat. No. 4,096,078 discloses lubricating oil compositions containing six essential additives, one of which is 4,4'-dithiodimorpholine.

U.S. Pat. No. 4,482,463 discloses the use of amine disulphides, including dimorpholino-disulphide, as extreme pressure agents in lubricating compositions which may also contain antioxidants, metal deactivators, rust inhibitors, VI improvers, pour point depressants, dispersant/detergents and other wear-resisting additives, including ZDDPs. In accordance with European Specification No. 328 488A, amine disulphides of the type disclosed in U.S. Pat. No. 4,482,463 can be reacted with certain phosphorus- and sulphur-containing compounds to produce zinc-free additives having good high pressure and antiwear properties and a reduced tendency to cause corrosion of copper.

DETAILED DESCRIPTION

As indicated earlier, the compositions of the invention contain added copper. The term "added copper" excludes copper present in the oil as a result of accumulation of copper in the oil during use, for example, as the result of wear or corrosion of copper-containing parts.

The proportion of added copper in the compositions of the invention is preferably at least 30 ppm. The proportion of added copper advantageously does not exceed 500 ppm, and preferably does not exceed 300 ppm. Especially advantageous compositions have proportions of copper in the range of from 50 to 300 ppm, preferably 50 to 250 ppm, most preferably 100 to 200 ppm.

The copper is stated above to be present in the composition in oil-soluble form. Where a substance is stated in this specification to be oil-soluble, this does not mean that the substance must be soluble in oil in all proportions. It does, however, mean that, in the final lubricating composition, for example, the composition in the form in which it is introduced into the crankcase of an engine, which composition may, and normally will, contain other additives, one or more of which may promote the solubility of the substance in question, the substance is soluble to an extent sufficient to have its intended effect in the environment in which the lubricating composition is employed. Further, the term oil-soluble as used herein also includes the case where a substance is colloidally dispersible in oil provided that in the final lubricating composition the substance can have its intended effect in the environment in which the lubricating composition is employed.

The copper is advantageously incorporated in the composition in the form of an oil-soluble copper compound. The copper may be in cuprous or cupric form. Examples of specifications disclosing suitable oil-soluble copper compounds include European Patent Specifications Nos. 24 146 B, 280 579 A and 280 580 A, the disclosures of all of which are incorporated herein by reference. Thus, for example, the copper may be blended into the oil as an oil-soluble copper salt of a synthetic or natural carboxylic acid. Examples of carboxylic acids from which suitable copper salts may be derived include $C_2$ to $C_{18}$ fatty acids, for example, acetic acid, stearic acid and palmitic acid; unsaturated acids, for example, oleic acid; branched carboxylic acids, for example, naphthenic acids of molecular weight of from 200 to 500, neodecanoic acid and 2-ethylhexanoic acid; and alkyl- or alkenyl-substituted dicarboxylic acids, for example, alkenyl-substituted succinic acids, for example, octadecenyl succinic acids, dodecenyl succinic acids and polyisobutenyl succinic acids. In some cases, suitable compounds may be derived from an acid anhydride, for example, from a substituted succinic anhydride.

Examples of copper compounds derived from polyalkenyl-substituted succinic acids or arthydrides are copper salts derived from polyisobutenyl succinic anhydride, and copper salts of polyisobutenyl succinic acid. Preferably, the copper is in its divalent cupric form, $Cu^{II}$. The preferred acids are polyalkenyl succinic acids in which the alkenyl group has a molecular weight greater than about 700. The alkenyl group desirably has a $M_n$ (which may conveniently be measured by an appropriately calibrated gel permeation chromatograph (GPC)) from about 900 to 1,400, with a $M_n$ of about 950 being most preferred.

The copper may be blended into the oil as a copper dithiocarbamate of the general formula $(RR'NCSS)_n$ Cu or a copper dithiophosphate of the general formula $[RO(R'O)P(S)S]_nCu$, where n is 1 or 2 and each of R and R', which may be the same or different, represents a hydrocarbyl radical containing 1 to 18, preferably 2 to 12 carbon atoms, for example, an alkyl, alkenyl, aryl, aralkyl, alkaryl or cycloalkyl radical. Other copper- and sulphur-containing compounds, for example, copper mercaptides, xanthates and thioxanthates, are also suitable for use in accordance with the invention, as are copper sulphonates, (optionally sulphurized) phenates and acetylacetonates.

Other copper compounds which may be used in accordance with the invention are overbased copper compounds. Examples of such compounds, and of processes for their preparation, are given, for example, in U.S. Pat. No. 4,664,822 and European Specification No. 0 425 367 A, the disclosures of both of which are incorporated herein by reference. In the preparative processes described in the U.S. patent, the copper is used in an essentially oil-insoluble form, for example as the chloride, sulphate or $C_1$ to $C_6$ carboxylate, but in the overbased product the copper is incorporated into the colloidally dispersed material in such a way that the product can act as an antioxidant for a lubricating composition. The European specification describes the use of copper $C_7$ to $C_{10}$ carboxylates which are partially soluble in hydrocarbons so that in the overbased product they are situated at the interface of the base oil and colloidally dispersed micelies. The copper-containing overbased products have an antioxidant effect when used in lubricating oils.

The copper may be introduced into the oil in an oil-insoluble form provided that in the finished lubricating composition the copper is in oil-soluble form.

The lubricating compositions of the invention also contain from 0.05 to 5 mass % of one or more diamine sulphides, especially diamine polysulphides, based on the total mass of the composition. The proportion of diamine sulphide(s) is advantageously 0.1 to 5 mass %, preferably 0.5 to 2 mass %.

Diamine sulphides for use in accordance with the invention contain a group of the formula $$-\overset{|}{N}-(S)_n-\overset{|}{N}-,$$

wherein n is an integer of at least 1, and each nitrogen atom is bonded to at least one moiety other than hydrogen, preferably to two moieties other than hydrogen.

Advantageously, the diamine sulphide, or at least one of the diamine sulphides, is of the general formula I:

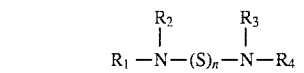

(I)

wherein n is an integer of from 1 to 6, advantageously 2 to 6, preferably 2; each of $R_1$ to $R_4$, which may be the same or different, represents a hydrogen atom or a substituted or unsubstituted hydrocarbyl radical, with the proviso that not more than one of $R_1$ and $R_2$ and not more than one of $R_3$ and $R_4$ represents hydrogen (preferably none of $R_1$ to $R_4$ represents hydrogen); or at least one of $R_1$—N($R_2$)— and $R_4$—N($R_3$)— represents a heterocyclic radical containing 5 to 12 ring members, the heterocyclic ring in the said radical being saturated or unsaturated, substituted or unsubstituted, and optionally containing an additional hetero atom selected from O, S and N-atoms, the said ring being linked to the —$(S)_n$-group via the or a N-atom.

The term "hydrocarbyl" as used herein means that the radical or group concerned is primarily composed of hydrogen and carbon atoms but does not exclude the presence of other atoms or groups in a proportion insufficient to detract from the substantially hydrocarbon characteristics of the group concerned.

Where any of $R_1$ to $R_4$ in general formula I represents a hydrocarbyl radical, that radical is advantageously a substituted or unsubstituted, straight chain or branched, (preferably $C_1$ to $C_{24}$) alkyl or (preferably $C_2$ to $C_{18}$) alkenyl radical, a substituted or unsubstituted (preferably $C_3$ to $C_{12}$) cycloalkyl radical, or a substituted or unsubstituted (preferably $C_7$ to $C_{30}$) alkaryl or aralkyl radical, or a substituted or unsubstituted aryl radical (preferably containing 6 to 10 carbon atoms in the nucleus).

Examples of alkyl radicals which $R_1$ to $R_4$ may represent are methyl, isopropyl, n-butyl, sec-butyl, tert-butyl, tert-amyl, 2-ethylhexyl, n-octyl, tert-octyl, n-dodecyl, 1,1,7,7-tetramethyloctyl and n-octadecyl radicals, with 2-ethylhexyl being preferred.

Examples of cycloalkyl radicals which $R_1$ to $R_4$ may represent are cyclopropyl, cyclopentyl, cyclohexyl, cycloheptyl, cyclooctyl and cyclododecyl radicals, with cyclohexyl radicals being preferred.

Examples of alkaryl radicals which $R_1$ to $R_4$ may represent are tolyl, xylyl, 2,6-diethylphenyl and 4-tert-butylphenyl radicals, while examples of aralkyl radicals are benzyl, phenylethyl and 2-phenyl-isopropyl radicals.

Examples of aryl radicals which $R_1$ to $R_4$ may represent are phenyl, α-naphthyl and β-naphthyl radicals.

Examples of heterocyclic radicals which $R_1$—N($R_2$)— and $R_4$—N($R_3$)— may represent are morpholino, piperazino, piperidino, pyrrolidino, hexamethyleneimino, imidazolidino, imidazo and pyrrolo radicals.

Examples of suitable substitutents in radicals represented by $R_1$ to $R_4$ are $R_5$ (except where $R_5$—see below—represents hydrogen), halogen, —$XR_5$, $XC(X)R_5$, poly(alkyleneoxy), —$C(X)R_5$, —$CXX'R_5$, —CXX'M, —$CXNR_6R_7$, -cyano, —XCN, —CNX,—NCX, —$NR_6R_7$, sulpho, sulphonato, sulphamoyl and alkoxysulphinyl, wherein each of X and X', which may be the same or different, represents —O—, —S—, —$S_2$, —SO—,—$SO_2$, or —$SO_3$, $R_5$ represents hydrogen or a substituted or unsubstituted alkyl or alkenyl radical (preferably a $C_1$ to $C_{18}$ alkyl or $C_2$ to $C_{18}$ alkenyl radical) each unsubstituted or substituted by —Cl, —XH, —XCN, —NCX, or —CN, M represents a metal atom (preferably, Na or K) or —$NR_6R_7R_8$, and each of $R_6$ to $R_8$, which may be the same or different, is defined in the same way as $R_5$. The heterocyclic ring of a heterocyclic radical represented by $R_1$—N(R)— or $R_4$—N($R_3$)— may be substituted by, for example, one or more of the radicals represented by $R_1$ to $R_4$.

Examples of specific substituents within the classes mentioned above are methyl, ethyl, isopropyl, n-butyl, vinyl, allyl, chlorine, mercapto, methylthio, methylsulphoxido, dodecylthio, dodecyldithio, sulpho, sulphonato, sulphamoyl, methoxysulphinyl, hydroxy, methoxy, ethoxy, allyloxy, n-octyloxy, 3,6,9,12,15-pentaoxa-heptadecyloxy, cyanato, thiocyanato, isothiocyanato, methoxycarbonyl, isooctyloxy carbonyl, carboxy, sodium carboxylato, acetoxy, 2-ethylhexanoyloxy, butanoyl, dimethylamino, bis-(2,2')dihydroxyethylamino, and didodecylamino. Any other suitable substituent may be used, provided that the diamine disulphide retains antioxidant properties.

In general formula I, each of $R_1$ and $R_2$, which may be the same or different, may, for example, represent a substituted or unsubstituted, straight chain or branched, $C_1$ to $C_{24}$ alkyl radical (preferably a $C_1$ to $C_{18}$ alkylradical). In this case, $R_3$ and $R_4$, which may be the same or different, advantageously have the same meanings as $R_1$ and $R_2$. In one advantageous embodiment $R_1$ to $R_4$ are identical, and each represents a $C_1$ to C 15 alkyl radical.

In a further advantageous embodiment in accordance with the invention, $R_1$—N($R_2$)— and $R_4$—N($R_3$)— in general formula I are identical and each represents a 5 to 12-membered heterocyclic radical as specified above. Preferably, each of the said heterocyclic radicals is a substituted or unsubstituted morpholino radical.

Diamine sulphides for use in accordance with the invention may be made by any suitable method. For example, disulphides may be made by a reaction represented by the equation:

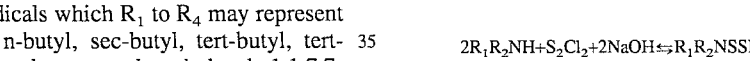

$$2R_1R_2NH+S_2Cl_2+2NaOH \leftrightarrows R_1R_2NSSNR_1\ R_2+2\ NaCl+2H_2O$$

Examples of methods of preparing diamine polysulphides are given in, for instance, M. C. Throdahl and M. W. Harman, "Ind. Eng. Chem.," 43, 1951, 421 to 429 and U.S. Pat. Nos. 3,644,408 and 4,482,463. The disclosures of all those documents are incorporated herein by reference. Where preparative methods give a mixture of diamine polysulphides, those mixtures can normally be used without separation.

The two-component antioxidant systems used in accordance with the invention do not depend for their effectiveness on the presence of phosphorus-containing compounds, for example, ZDDPs. Thus, while the antioxidant systems are suitable for use in compositions in which ZDDPs are used to provide antiwear properties, the systems are also suitable for use in systems containing low or zero amounts of phosphorus (for example, less than 0.1 mass % phosphorus, especially less than 0.05 mass % phosphorus), and advantageously substantially free of phosphorus, or containing low or zero amounts of both phosphorus and zinc. Accordingly, the invention also provides a composition according to the invention which contains less than 0.1 mass % phosphorus.

It may be desirable for oils containing low or zero amounts of phosphorus to contain an effective amount of a bearing corrosion inhibitor. The use of a bearing corrosion inhibitor may, in particular, be advantageous if a polyamine sulphide containing 3 or more sulphur atoms is used.

Bearing corrosion inhibitors inhibit corrosion effects on bearings such as Cu/Pb bearings, where, for example, copper staining and/or high weight loss can be a problem. Such additives have been found to enhance the antiwear performance of lubricating oils. Preferred corrosion inhibitors for use in accordance with the invention are borate esters and thiadiazole mercaptans, for example, the borate esters and thiadiazole mercaptans (including derivatives thereof) described in European Specifications Nos. 280 579 A and 280 580 A. The proportion of bearing corrosion inhibitor(s) to be included in any particular composition will depend on the nature and proportion of the other components in the formulation, but typically about 0.1 mass % of bearing corrosion inhibitor would be used.

Where the antioxidant systems are used in compositions which do not contain ZDDPs or other phosphorus-containing antiwear agents, or contain only very low levels of such agents, it may be desirable for the final composition to contain an additional antiwear agent or system. (Some antiwear properties will normally be imparted by the diamine sulphides.) Thus, for example, the composition may contain, in addition to the added copper and the diamine sulphides, one or more other oil-soluble sulphur-containing compounds such that the composition comprises from greater than 0.2 mass % to 2.0 mass % of total sulphur. The proportion of additional oil-soluble sulphur-containing compound(s) to be included in any particular composition will depend on the nature and proportion of the other constituents of the composition, but typically about 0.5 % mass of additional sulphur-containing compound(s) will be used.

Examples of oil-soluble sulphur-containing compounds which may be incorporated in lubricating compositions, in addition to the diamine sulphides, to enhance the antiwear properties of the compositions are dithiocarbamates, mercaptides, sulphurized unsaturated organic compounds, including sulphurized olefins; sulphurized Dieis-Alder products; and, particularly, sulphurized unsaturated alcohols and esters, for example sperm oil substitutes; sulphides, including di- and poly-sulphides; thioethers; thiophenols; thioxanthates (including copper thioxanthates as indicated above); sulphurized esters; thioesters; thioamides; thiazoles, for example benzothiazoles and, particularly, mercaptobenzothiazoles and thiadiazoles. These compounds may also enhance antioxidant properties. Examples of oil-soluble sulphur-containing compounds are given in European Specifications Nos. 280 579 A and 280 580 A.

As indicated in more detail below, additional additives may be incorporated in the compositions of the invention to enable them to meet particular requirements. Thus, for example, the compositions advantageously also comprise:

(A) a total of from 1 to 10 mass % of one or more ashless dispersant compounds; or (B) a total of 0.3 to 10 mass % of one or more nitrogen- or ester-containing viscosity index improver dispersants; or (C) a mixture of an ashless dispersant compound and a said viscosity index improver dispersant.

The compositions advantageously further comprise a metal-containing detergent. Thus, for example, the compositions may contain a total of from 2 to 8000 ppm of calcium and/or magnesium, and preferably comprise from 500 to 5000 ppm of calcium and/or magnesium as a basic calcium sulphonate and/or a basic magnesium sulphonate. The compositions may comprise, for example, 0.01 to 5 mass % of one or more other lubricant antioxidants, particularly one or more sulphurized alkyl phenols and/or ZDDPs (unless it is desired that the compositions be substantially free of phosphorus, or contain only low levels thereof).

The components of the antioxidant system used in accordance with the invention may be incorporated into a base oil in any convenient way. Thus, each of the components can be added directly to the oil by dispersing or dissolving it in the oil at the desired level of concentration. Such blending may occur at ambient temperature or at an elevated temperature.

The components of the antioxidant system may be incorporated individually or together into the base oil. Where the components are added together they are conveniently added in the form of a concentrate comprising a solution, typically in oil, containing (1) from 10 ppm to 30 mass %, advantageously 10 ppm to 5 mass %, preferably 300 to 2000 ppm, of copper present in oil-soluble form; and (2) from 0.5. to 50 mass %, preferably 0.5 to 20 mass %, and most preferably 10 to 20 mass %, of one or more oil-soluble diamine sulphides.

Such a concentrate advantageously also comprises (A) from 0 to 60 mass % of ashless dispersant and/or from 0 to 40 mass % of polymeric viscosity index improver dispersant (although such a viscosity index improver dispersant would normally be added separately), and/or (B) 0 to 60 mass %, for example 10 to 25 mass %, of metal-containing detergent. For example, the concentrate may contain a total of from 0 to 8 mass % of calcium and/or magnesium. The concentrate may also contain a total of from 0 to 60 mass % of one or more zinc dihydrocarbyl dithiophosphates. If desired, the concentrate may contain less than 0.1 mass % of phosphorus. As indicated later in this specification, other additives may also be present in concentrates.

All proportions given in this specification are based on the total mass of the final composition or concentrate, including the mass of any additional constituents not specifically referred to.

Base oils suitable for use in the compositions of the invention include those suitable for use as crankcase lubricating oils for spark-ignited and compression-ignited internal combustion engines, for example, automobile and truck engines, marine and railroad diesel engines. They may also be used, for example, in base oils suitable for use as aviation lubricants or as lubricants for two cycle engines. Synthetic or natural base oils may be used.

As indicated above, additional additives may be incorporated in the compositions of the invention to enable them to meet particular requirements. Examples of additives which may be included in lubricating oil compositions are detergents and metal rust inhibitors, viscosity index improvers, corrosion inhibitors, other oxidation inhibitors, friction modifiers, dispersants, anti-foaming agents, anti-wear agents, pour point depressants, and rust inhibitors.

In accordance with the invention, the use of a supplementary antioxidant is not normally necessary. A supplementary antioxidant may however be used if desired or required in a particular case. Examples of supplementary antioxidants include antioxidants mentioned earlier in this specification. Suitable supplementary antioxidants include, for example, other aromatic amines, for example alkylated diphenylamines and phenyl α-napthylamine; hindered phenols; alkaline earth metal salts of sulphurized alkylphenols having preferably $C_5$ to $C_{12}$ alkyl side chains, e.g., calcium nonylphenyl sulphide; barium octylphenyl sulphide; phosphosulphurized or sulphurized hydrocarbons; and other oil-soluble copper compounds, for example those mentioned earlier in this specification.

When lubricating compositions contain one or more of the above-mentioned additives, each additive is typically blended into the base oil in an amount which enables the additive to provide its desired function. Representative effective amounts of such additives, when used in crankcase lubricants, are as follows:

| Additive | Mass % a.i.* (Broad) | Mass % a.i. (Preferred) |
|---|---|---|
| Detergents/Rust inhibitors | 0.01–6 | 0.01–4 |
| Viscosity Modifier | 0.01–6 | 0.01–4 |
| Corrosion Inhibitor | 0.01–5 | 0.01–1.5 |
| Oxidation Inhibitor | 0.01–5 | 0.01–1.5 |
| Dispersant | 0.1–20 | 0.1–8 |
| Pour Point Depressant | 0.01–5 | 0.01–1.5 |
| Anti-Foaming Agent | 0.001–3 | 0.001–0.15 |
| Anti-wear Agents | 0.01–6 | 0.01–4 |
| Friction Modifier | 0.01–5 | 0.01–1.5 |
| Mineral or Synthetic Base Oil | Balance | Balance |

*Mass % active ingredient based on the final oil.

As indicated earlier, when a plurality of additives are employed it may be desirable, although not essential, to prepare one or more additive concentrates comprising the additives (concentrates sometimes being referred to herein as additive packages) whereby several additives can be added simultaneously to the base oil to form the lubricating oil composition. Dissolution of the additive concentrate(s) into the lubricating oil may be facilitated, for example, by mixing with heating, but this is not essential. The concentrate(s) or additive package(s) will typically be formulated to contain the additive(s) in proper amounts to provide the desired concentration in the final formulation when the additive package(s) is or are combined with a predetermined amount of base lubricant. Thus, the components of the antioxidant system used in accordance with the present invention can be added to small amounts of base oil or other compatible solvents along with other desirable additives to form one or more additive packages containing active ingredients in an amount, based on the additive package, of, for example, from about 2.5 to about 90 mass %, and preferably from about 5 to about 75 mass %, and most preferably from about 8 to about 50 mass % by weight, additives in the appropriate proportions with the remainder being base oil.

The final formulations may employ typically about 10 mass % of the additive package(s) with the remainder being base oil.

The following Examples illustrate the invention. In the Examples, all proportions of constituents are active ingredient proportions by mass, calculated on the mass of the total composition, unless otherwise specified.

Two comparative compositions (Comparative Examples 1 and 2) and two compositions according to the invention (Example 1 and Example 2) were prepared. The compositions of the invention were free from phosphorus. Each composition contained, in addition to a basestock, the same proportions of a viscosity index improver dispersant, an ashless dispersant, an overbased magnesium sulphonate detergent, and cupric oleate (to give 250 ppm copper in the final composition). Each composition also contained a sulphur-containing compound in such a proportion that the final composition contained 0.23 mass % added sulphur.

The susceptibility of each of the compositions to oxidation was measured using a bench test, the ERCOT test, designed to simulate the oxidative, iron-catalysed reactive environment of an internal combusion engine. In the ERCOT test, a sample of the composition under test containing ferric acetylacetonate giving 40 ppm iron as catalyst is oxidized by passing air through the composition at elevated temperature, and the viscosity is determined at intervals using a Haake viscometer.

The results obtained are given in Table I, where "TVTM" means "too viscous to measure". The sulphurized hydrocarbon was Mobilad C-100. The morpholine disulphide (4,4'-dithiodimorpholine) used in Example 1 had the formula

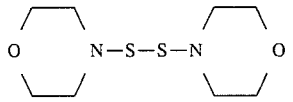

while the di(dimethylmorpholine) disulphide (4,4'-dithiodi-(dimethylmorpholine) used in Example 2 had the formula

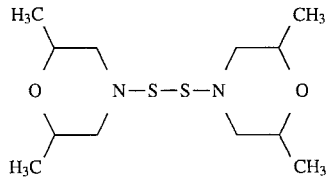

TABLE 1

| Comp. Ex./ Example | Comp. Ex. 1 | Comp. Ex. 2 | Example 1 | Example 2 |
|---|---|---|---|---|
| S-containing compound | Dipri-mary alkyl ZDDP | Sulphur-ized hydro-carbon | Di-morpholine disulphide | Di(dimethyl morpholine) disulphide |
| Proportion of S-containing compound (mass %) | 1.44 | 0.53 | 0.84 | 1.05 |
| ERCOT viscos-ity at hours | | | | |
| 0 | 75 | 78 | 76 | 74 |
| 16 | 78 | 71 | 77 | 72 |
| 24 | 78 | 76 | 77 | 76 |
| 40 | 160 | 196 | 93 | 95 |
| 48 | TVTM | TVTM | 164 | 146 |
| 64 | — | — | TVTM | 255 |

It can be seen from Table I that the sulphur-containing compounds used in Examples 1 and 2, that is, compounds for use in accordance with the invention, gave compounds which performed better in the ERCOT test than compositions containing the ZDDP or the sulphurized hydrocarbon. The superior performance of the composition of Example 2 over that of Example 1 may be a result of the fact that di(dimethylmorpholine) disulphide has a somewhat greater solubility in oil than does the unsubstituted dimorpholine disulphide, but the invention is not to be regarded as limited in any way by this explanation.

We claim:

1. A lubricating oil composition suitable for use as a crankcase lubricant, comprising a major amount of a lubricating oil, at least 5 parts per million by mass (ppm) of added copper present in oil-soluble form, and from 0.05 to 5 mass % of one or more oil-soluble diamine sulfides, and wherein said composition contains less than 0.1 mass % phosphorous, and wherein said aliamine sulfide, or at least one diamine sulfide, is of the general formula:

$$R_1-\overset{\overset{R_2}{|}}{N}-(S)_n-\overset{\overset{R_3}{|}}{N}-R_4$$

wherein n is an integer of from 1 to 6; each of $R_1$ to $R_4$, which may be the same or different, represents a hydrogen atom or a substituted or unsubstituted hydrocarbyl radical, with the proviso that no more than one of $R_1$ and $R_2$ not more than one of $R_3$ and $R_4$ represents hydrogen; or at least one of $R_1$—N($R_2$)— and $R_4$—N—($R_3$)— represents a heterocylic radical containing 5 to 12 ring members, the heterocyclic ring in the said radical being saturated or unsaturated, substituted or unsubstituted, and optionally containing an additional heteroatom selected from O, S, and N-atoms, the said ring being linked to the —$(S)_n$— group via the N atom.

2. A composition as claimed in claim 1, wherein the proportion of added copper is from 50 to 300 ppm.

3. A composition as claimed in claim 2, wherein the copper is incorporated in the composition as an oil-soluble copper salt of a $C_2$ to $C_{18}$ fatty acid, an unsaturated carboxylic acid, a naphthenic acid of molecular weight of from 200 to 500, or an alkyl- or alkenyl-substituted dicarboxylic acid, an oil-soluble copper dithiocarbamate of the general formula $(RR'NCSS)_nCu$ or oil-soluble copper thiophosphate of the general formula $[RO(R'O)P(S)S]_nCu$, where n is 1 or 2 and each of R and R', which may be the same or different, represents a hydrocarbyl radical containing 1 to 18 carbon atoms, or an oil-soluble copper sulphonate, phenate or acetylacetonate.

4. A composition as claimed in claim 2, wherein the proportion of diamine sulphide is 0.5 to 2 mass %.

5. A composition as claimed in claim 1, wherein the proportion of diamine sulphide is 0.1 to 5 mass %.

6. A composition as claimed in claim 1, wherein n is an integer of from 2 to 6.

7. A composition as claimed in claim 1, wherein n is 2.

8. A composition as claimed in claim 1, wherein at least one of $R_1$ to $R_4$ represents a hydrocarbyl radical which is a substituted or unsubstituted, straight chain or branched, alkyl or alkenyl radical, or a substituted or unsubstituted cycloalkyl alkaryl, aralkyl, or aryl radical.

9. A composition as claimed in claim 1, wherein either a) $R_1$ to $R_4$, which may be the same or different, each represents a straight chain or branched $C_1$ to $C_{18}$ alkyl radical; or b) $R_1$—$N(R_2)$— and $R_4$—$N(R_3)$— are identical and each represents a 5- to 12-membered heterocyclic radical.

10. A composition as claimed in claim 9, wherein the polyamine sulphide is as defined in a) and $R_1$ to $R_4$ are identical and each represents a $C_1$ to $C_{15}$ alkyl radical.

11. A composition as claimed in claim 9, wherein the polyamine sulphide is as defined in b) and each of the heterocyclic radicals is a substituted or unsubstituted morpholino radical.

12. A composition as claimed in claim 1, which is substantially free of phosphorus.

13. A composition as claimed in claim 1, which also comprises:

(A) a total from 1 to 10 mass % of one or more ashless dispersant compounds;

(B) a total of 0.3 to 10 mass % of one or more nitrogen- or ester-containing viscosity index improver dispersants, or (C) a mixture of an ashless dispersant compound and a said viscosity index improver dispersant.

14. A composition as claimed in claim 1, which also comprises a metal-containing detergent.

15. A composition as claimed in claim 14, which comprises a total of from 500 to 5000 ppm of calcium and/or magnesium as a basic calcium sulphonate and/or basic magnesium sulphonate.

16. A concentrate comprising an oil solution containing:

(1) from 10 ppm to 30 mass % of copper present in oil soluble form; and (2) from 0.5 to 50 mass % of one or more oil-soluble diamine sulphides.

17. A concentrate as claimed in claim 16, which further comprises up to 60 mass % of metal-containing detergent.

* * * * *